US008241444B1

(12) United States Patent
Hordos et al.

(10) Patent No.: US 8,241,444 B1
(45) Date of Patent: Aug. 14, 2012

(54) GAS GENERANT COMPOSITION

(75) Inventors: Deborah L. Hordos, Troy, MI (US); Slaven Domazet, Sterling Heights, MI (US); Sean P. Burns, Almont, MI (US)

(73) Assignee: TK Holdings, Inc., Armada, MI (US)

( * ) Notice: Subject to any disclaimer, the term of this patent is extended or adjusted under 35 U.S.C. 154(b) by 100 days.

(21) Appl. No.: 12/802,227

(22) Filed: Jun. 1, 2010

Related U.S. Application Data

(60) Provisional application No. 61/217,269, filed on May 29, 2009.

(51) Int. Cl.

| | |
|---|---|
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/46; 149/45; 149/109.2; 149/109.4

(58) Field of Classification Search ..... 149/46, 149/45, 109.2, 109.4
See application file for complete search history.

(56) References Cited

U.S. PATENT DOCUMENTS

2007/0246138 A1* 10/2007 Hordos et al. ..... 149/74
* cited by examiner

*Primary Examiner* — James McDonough
(74) *Attorney, Agent, or Firm* — L.C. Begin & Associates, PLLC.

(57) ABSTRACT

Gas generating compositions include a primary fuel selected from fumaric acid, succinic acid, cyanuric acid, barbituric acid, and mixtures thereof; an oxidizer selected from phase stabilized ammonium nitrate, potassium perchlorate, and mixtures thereof; a secondary fuel selected from tetrazoles, bitetrazoles, salts of bitetrazoles, derivatives of bitetrazoles, and mixtures thereof; and an oxide selected from molybdenum trioxide, ferric (III) oxide, and mixtures thereof. Gas generators and vehicle occupant protection systems incorporating the present compositions are also described.

17 Claims, 1 Drawing Sheet

GAS GENERANT COMPOSITION

CROSS-REFERENCE TO RELATED APPLICATIONS

This application claims the benefit of U.S. Provisional Application Ser. No. 61/217,269 filed on May 29, 2009.

TECHNICAL FIELD

The present invention relates generally to gas generating systems, and to gas generating compositions employed in gas generator devices for automotive restraint systems, for example.

BACKGROUND OF THE INVENTION

The present invention relates to nontoxic gas generating compositions that upon combustion rapidly generate gases that are useful for inflating occupant safety restraints in motor vehicles and specifically, the invention relates to thermally stable nonazide gas generants having not only acceptable burn rates, but that also, upon combustion, exhibit a relatively high gas volume to solid particulate ratio at acceptable flame temperatures.

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are hereby incorporated by reference.

In addition to a fuel constituent, pyrotechnic nonazide gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. When employed in a vehicle occupant protection system, the solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate. In this manner, the overall weight of the inflator may be reduced because of the corresponding reduction in filtering needs.

The use of phase stabilized ammonium nitrate as an oxidizer, for example, is desirable because it generates abundant nontoxic gases and minimal solids upon combustion. To be useful in certain applications, however, gas generants for automotive applications must be thermally stable when aged for 400 hours or more at 107 degree. C. The compositions must also retain structural integrity when cycled between −40.degree. C. and 107.degree. C.

Yet another contributor to the overall weight of a typical gas generator is the structural requirements that ensure the structural integrity of the inflator during actuation thereof.

Oftentimes, it is necessary to include an enhanced inflator housing that accommodates the higher pressures necessary to ensure consistent performance when combusting the associated gas generating composition. As such, typical inflator housings are relatively heavy due to the greater thickness of the metallic housing. Furthermore, the welding and other sealing methods used to seal and aggregate the housing constituents are also more relatively complex.

Accordingly, ongoing efforts in the design of automotive gas generating systems, for example, include initiatives that desirably produce more gas and less solids without the drawbacks mentioned above.

SUMMARY OF THE INVENTION

The above-referenced concerns are resolved by a gas generating composition containing a primary fuel selected from fumaric acid, succinic acid, barbituric acid, cyanuric acid, and a mixture of two or more of said primary fuels; a secondary fuel selected from tetrazoles, bitetrazoles, salts of bitetrazoles, derivatives of bitetrazoles, and mixtures thereof; and an oxidizer selected from phase stabilized ammonium nitrate, potassium perchlorate, and mixtures thereof. Oxides such as ferric (III) oxide and molybdenum trioxide may also be added to enhance the thermal behavior and dramatically reduce the thermal activation of the composition.

DETAILED DESCRIPTION OF THE INVENTION

Figure 1:
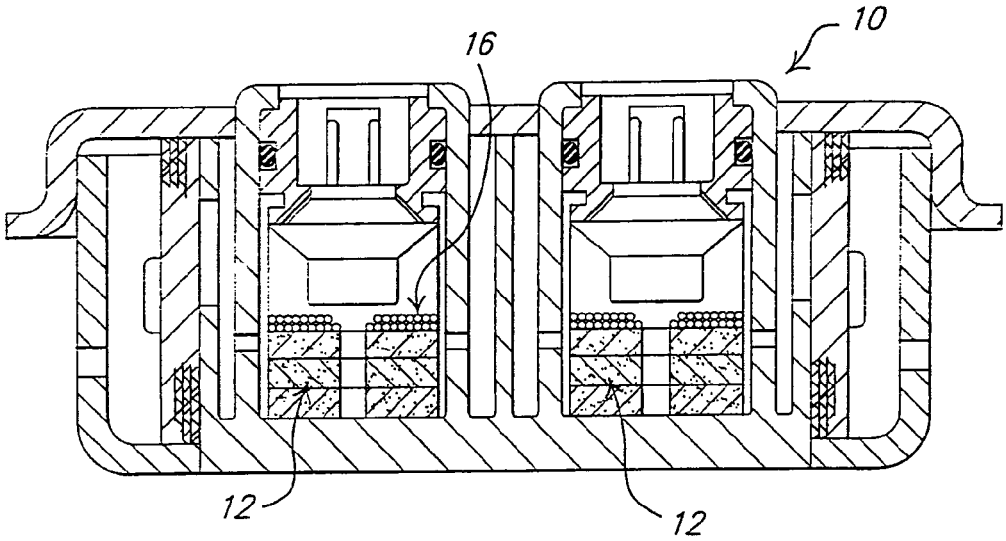
FIG. 1 is a cross-sectional side view showing the general structure of an inflator in accordance with the present invention.

Gas generants or gas generating compositions are presented that include phase stabilized ammonium nitrate as an oxidizer. The phase stabilized ammonium nitrate (PSAN) is preferably prepared by co-precipitating about 90 wt % of ammonium nitrate with about 10 wt % potassium nitrate in a known manner. The ratio of potassium nitrate to ammonium nitrate may range from 5-15 wt % of potassium nitrate to 85-95 wt % ammonium nitrate as co-precipitated together. Other percentages may be employed in a known manner and in the respective effect weight percents. All weight percents in this specification are stated by weight of the total respective composition. Of course, other methods of stabilizing the ammonium nitrate are considered, and therefore, the term "phase stabilized ammonium nitrate" includes other types of PSAN that are also contemplated. These include but are not limited to ammonium nitrate stabilized with a potassium-containing constituent such as a potassium tetrazole or potassium perchlorate, ammonium nitrate stabilized with nitroguanidine, and so forth as understood by those of ordinary skill in the art. The oxidizer and more specifically, an oxidizer selected from phase stabilized ammonium nitrate, potassium perchlorate, and mixtures thereof is provided at about 60-80 weight percent of the total composition.

A first fuel is selected from fumaric acid, succinic acid, barbituric acid, cyanuric acid, and mixtures thereof and is provided at about 5-15 weight percent of the total composition, and more preferably at about 9-13 weight percent. More preferably, the first fuel is selected from fumaric acid.

A second fuel is selected from tetrazoles, bitetrazoles, salts of bitetrazoles, derivatives of bitetrazoles, and mixtures thereof. U.S. Pat. No. 5,875,329 exemplifies certain bitetrazoles, salts, and derivatives thereof and is herein incorporated by reference. Exemplary bitetrazoles, salts, and derivatives include bitetrazole amine (BTA), mono-ammonium salt of bitetrazole amine, and 5,5'-Bis-1H-tetrazole (BHT). The second fuel is provided at about 8-30 weight percent of the total composition, and more preferably at about 10-27 weight percent. More preferably, the second fuel is selected from monoammonium salt of bitetrazole amine (BTA).

A metal oxide may be provided at about 1 to 5 weight percent of the total composition. The metal oxide is preferably selected from molybdenum trioxide, ferric (III) oxide, and mixtures thereof. More preferably, the metal oxide is selected from molybdenum trioxide.

A processing aid is optionally provided at about 0-1 weight percent. The processing aid, lubricant, or flow agent is preferably selected from silica, graphite, and mixtures thereof.

The various gas generant constituents described above may be dry-mixed or wet-mixed in a known manner. For example, the various constituents may be comminuted in a planetary mixer to result in a dry, homogeneous mixture. The mixture may then be compacted and pelletized in a known manner, or may simply be used in a granulated manner or form. Alternatively, the various gas generant constituents may be dissolved in an aqueous solution, stirred, and then co-precipitated to form a solid solution.

The compositions of the present invention are formed from constituents as provided by known suppliers such as Aldrich or Fisher Chemical companies. The compositions may be provided in granulated form and dry-mixed and compacted in a known manner, or otherwise mixed as known in the art. The compositions may be employed in gas generators typically found in airbag devices or occupant protection systems, or in safety belt devices, or in gas generating systems such as a vehicle occupant protection system, all manufactured as known in the art, or as appreciated by one of ordinary skill.

The following examples illustrate the present invention:

Comparative Example 1

A gas generating composition was made in accordance with the present invention. Taking 100 dry grams of granulated solids as a basis, 66.13 g of ammonium nitrate, 7.35 g of potassium nitrate, and about 26.52 g of mono-ammonium salt of bitetrazole amine were dissolved in an aqueous bath, within a Ross double-jacketed planetary mixer. The bath was heated to at least 80 C and stirred while heating. The water was then evaporated to produce a solid solution of the solid constituents. When combusted, the solid solution resulted in about 4.01 mols of gas per 100 grams of solid solution or gas generating composition. Stated another way, the gas generating composition when combusted resulted in 6.80 mols of gas per 100 cubic centimeters of gas generating composition. The total combustion solids were about 3.9 wt % of the total combustion products of gas and solids.

Example 2

A gas generating composition was co-precipitated as described in Example 1 including the following constituents: taking 100 dry grams of granulated solids as a basis, 68.20 g of ammonium nitrate, 7.58 g of potassium nitrate, 10.00 g of fumaric acid, and about 14.22 g of mono-ammonium salt of bitetrazole amine were combined into a solid solution. When combusted, the solid solution resulted in about 3.92 mols of gas per 100 grams of solid solution or gas generating composition. Stated another way, the gas generating composition when combusted resulted in 6.78 mols of gas per 100 cubic centimeters of gas generating composition. The total combustion solids were about 3.5 wt % of the total combustion products of gas and solids.

Example 3

A gas generating composition was co-precipitated as described in Example 1 including the following constituents: taking 100 dry grams of granulated solids as a basis, 69.45 g of ammonium nitrate, 7.72 g of potassium nitrate, 10.00 g of succinic acid, and about 12.83 g of mono-ammonium salt of bitetrazole amine were combined into a solid solution. When combusted, the solid solution resulted in about 3.96 mols of gas per 100 grams of solid solution or gas generating composition. Stated another way, the gas generating composition when combusted resulted in 6.83 mols of gas per 100 cubic centimeters of gas generating composition. The total combustion solids were about 3.6 wt % of the total combustion products of gas and solids.

Example 4

A gas generating composition was co-precipitated as described in Example 1 including the following constituents: taking 100 dry grams of granulated solids as a basis, 65.577 g of ammonium nitrate, 7.29 g of potassium nitrate, 9.62 g of fumaric acid, 3.85 g of molybdenum trioxide, and about 13.67 g of mono-ammonium salt of bitetrazole amine were combined into a solid solution. When combusted, the solid solution resulted in about 3.78 mols of gas per 100 grams of solid solution or gas generating composition. Stated another way, the gas generating composition when combusted resulted in 6.70 mols of gas per 100 cubic centimeters of gas generating composition. The total combustion solids were about 6.8 wt % of the total combustion products of gas and solids.

Example 5

A gas generating composition was co-precipitated as described in Example 1 including the following constituents: taking 100 dry grams of granulated solids as a basis, 64.133 g of ammonium nitrate, 5.58 g of potassium nitrate, 10.00 g of fumaric acid, 5.00 g of potassium perchlorate, and about 15.29 g of mono-ammonium salt of bitetrazole amine were combined into a solid solution. When combusted, the solid solution resulted in about 3.82 mols of gas per 100 grams of solid solution or gas generating composition. Stated another way, the gas generating composition when combusted resulted in 6.69 mols of gas per 100 cubic centimeters of gas generating composition. The total combustion solids were about 5.3 wt % of the total combustion products of gas and solids.

Example 6

A gas generating composition was co-precipitated as described in Example 1 including the following constituents: taking 100 dry grams of granulated solids as a basis, 62.918 g of ammonium nitrate, 5.47 g of potassium nitrate, 10.00 g of fumaric acid, 5.00 g of potassium perchlorate, 1.50 g of molybdenum trioxide, and about 15.11 g of mono-ammonium salt of bitetrazole amine were combined into a solid solution. When combusted, the solid solution resulted in about 3.76 mols of gas per 100 grams of solid solution or gas generating composition. Stated another way, the gas generating composition when combusted resulted in 6.64 mols of gas per 100 cubic centimeters of gas generating composition. The total combustion solids were about 6.6 wt % of the total combustion products of gas and solids. The auto-ignition temperature of the composition, as measured by the METTLER thermal analysis, was found to have an onset of 184.96 C and a peak of 223.28 C.

An inflator is provided as described in co-owned U.S. Pat. No. 7,267,365, herein incorporated by reference. A plurality of gas exit orifices were arranged about the periphery of the housing, whereby the holes were varied in a first trial to be six in quantity with a diameter of about 2.2 mm. The inflator contained a composition as described in Example 1. When the first inflator was actuated, the combustion pressure was measured to be about 37 MPa at its maximum. Three other inflators designed in the same way, and containing the composition of this example, were provided with ten gas exit orifices about the periphery of the housing, whereby the second, third, and fourth inflators had gas exit orifices having diameters of 2.1 mm, 2.2 mm, and 2.3 mm, respectively. When these inflators were activated, the combustion pressures of the second, third, and fourth inflators were measured to be about 29 MPa, 27 MPa, and 23 MPa, respectively. The tank pressure of the second, third, and fourth inflators remained substantially the same over time with maximum tank pressures measured to be about 160 kPa, 175 kPa, and 180 Kpa, respectively, and each of the tank pressures having essentially the same curve of pressure over time. It can therefore be seen that the present compositions, as exemplified by this composition, exhibit adequate and sufficient performance even when reducing the combustion pressure. As a result, the inflator filter may be reduced because of the reduced heat sink requirements attendant to the improved combustion pressure profiles.

Example 7

A gas generating composition was co-precipitated as described in Example 1 including the following constituents: taking 100 dry grams of granulated solids as a basis, 62.265 g of ammonium nitrate, 5.41 g of potassium nitrate, 9.71 g of fumaric acid, 4.85 g of potassium perchlorate, 2.91 g of iron (III) oxide, and about 14.84 g of mono-ammonium salt of bitetrazole amine were combined into a solid solution. When combusted, the solid solution resulted in about 3.71 mols of gas per 100 grams of solid solution or gas generating composition. Stated another way, the gas generating composition when combusted resulted in 6.62 mols of gas per 100 cubic centimeters of gas generating composition. The total combustion solids were about 7.8 wt % of the total combustion products of gas and solids.

Example 8

A gas generating composition was co-precipitated as described in Example 1 including the following constituents: taking 100 dry grams of granulated solids as a basis, 62.265 g of ammonium nitrate, 5.41 g of potassium nitrate, 9.71 g of fumaric acid, 4.85 g of potassium perchlorate, 2.91 g of iron (III) oxide, and about 14.84 g of mono-ammonium salt of bitetrazole amine were combined into a solid solution. When combusted, the solid solution resulted in about 3.71 mols of gas per 100 grams of solid solution or gas generating composition. Stated another way, the gas generating composition when combusted resulted in 6.62 mols of gas per 100 cubic centimeters of gas generating composition. The total combustion solids were about 7.8 wt % of the total combustion products of gas and solids.

Example 9

A gas generating composition was co-precipitated as described in Example 1 including the following constituents: taking 100 dry grams of granulated solids as a basis, 62.265 g of ammonium nitrate, 5.41 g of potassium nitrate, 9.71 g of fumaric acid, 4.85 g of potassium perchlorate, 2.91 g of iron (III) oxide, and about 14.84 g of mono-ammonium salt of bitetrazole amine were combined into a solid solution. When combusted, the solid solution resulted in about 3.71 mols of gas per 100 grams of solid solution or gas generating composition. Stated another way, the gas generating composition when combusted resulted in 6.62 mols of gas per 100 cubic centimeters of gas generating composition. The total combustion solids were about 7.8 wt % of the total combustion products of gas and solids.

Example 10

A gas generating composition was co-precipitated as described in Example 1 including the following constituents: taking 100 dry grams of granulated solids as a basis, 68.32 g of ammonium nitrate, 3.60 g of potassium nitrate, 13.00 g of fumaric acid, 5.00 g of potassium perchlorate, and about 10.08 g of mono-ammonium salt of bitetrazole amine were combined into a solid solution. When combusted, the solid solution resulted in about 3.84 mols of gas per 100 grams of solid solution or gas generating composition. Stated another way, the gas generating composition when combusted resulted in 6.68 mols of gas per 100 cubic centimeters of gas generating composition. The total combustion solids were about 4.4 wt % of the total combustion products of gas and solids.

Example 11

A gas generating composition was co-precipitated as described in Example 1 including the following constituents: taking 100 dry grams of granulated solids as a basis, 66.46 g of ammonium nitrate, 15.00 g of fumaric acid, 10.11 g of potassium perchlorate, and about 8.43 g of mono-ammonium salt of bitetrazole amine were combined into a solid solution. When combusted, the solid solution resulted in about 3.76 mols of gas per 100 grams of solid solution or gas generating composition. Stated another way, the gas generating composition when combusted resulted in 6.62 mols of gas per 100 cubic centimeters of gas generating composition. The total combustion solids were about 5.4 wt % of the total combustion products of gas and solids.

Example 12

A gas generating composition was co-precipitated as described in Example 1 including the following constituents: taking 100 dry grams of granulated solids as a basis, 67.55 g of ammonium nitrate, 13.00 g of fumaric acid, 6.60 g of potassium perchlorate, 0.50 g of iron (III) oxide, 3.04 g of potassium sulfate, and about 9.31 g of mono-ammonium salt of bitetrazole amine were combined into a solid solution. When combusted, the solid solution resulted in about 3.77 mols of gas per 100 grams of solid solution or gas generating composition. Stated another way, the gas generating composition when combusted resulted in 6.66 mols of gas per 100 cubic centimeters of gas generating composition. The total combustion solids were about 5.6 wt % of the total combustion products of gas and solids.

Example 13

A gas generating composition was co-precipitated as described in Example 1 including the following constituents: taking 100 dry grams of granulated solids as a basis, 66.356 g of ammonium nitrate, 4.24 g of potassium nitrate, 7.00 g of fumaric acid, 5.00 g of potassium perchlorate, and about 17.41 g of mono-ammonium salt of bitetrazole amine were combined into a solid solution. When combusted, the solid solution resulted in about 3.89 mols of gas per 100 grams of solid solution or gas generating composition. Stated another way, the gas generating composition when combusted resulted in 6.80 mols of gas per 100 cubic centimeters of gas generating composition. The total combustion solids were about 4.7 wt % of the total combustion products of gas and solids.

Example 14

A gas generating composition was co-precipitated as described in Example 1 including the following constituents: taking 100 dry grams of granulated solids as a basis, 68.46 g of ammonium nitrate, 7.61 g of potassium nitrate, 11.00 g of cyanuric acid, and about 12.93 g of mono-ammonium salt of bitetrazole amine were combined into a solid solution. When combusted, the solid solution resulted in about 3.94 mols of gas per 100 grams of solid solution or gas generating composition. Stated another way, the gas generating composition when combusted resulted in 7.10 mols of gas per 100 cubic centimeters of gas generating composition. The total combustion solids were about 3.5 wt % of the total combustion products of gas and solids.

Example 15

A gas generating composition was co-precipitated as described in Example 1 including the following constituents: taking 100 dry grams of granulated solids as a basis, 69.93 g of ammonium nitrate, 7.77 g of potassium nitrate, 11.00 g of barbituric acid, and about 11.29 g of mono-ammonium salt of bitetrazole amine were combined into a solid solution. When combusted, the solid solution resulted in about 3.92 mols of gas per 100 grams of solid solution or gas generating composition. Stated another way, the gas generating composition when combusted resulted in 7.08 mols of gas per 100 cubic centimeters of gas generating composition. The total combustion solids were about 3.6 wt % of the total combustion products of gas and solids.

Example 16

A gas generating composition was co-precipitated as described in Example 1 including the following constituents: taking 100 dry grams of granulated solids as a basis, 68.46 g of ammonium nitrate, 7.61 g of potassium nitrate, 10.00 g of fumaric acid, and about 15.36 g of mono-ammonium salt of bitetrazole amine were combined into a solid solution. When combusted, the solid solution resulted in about 3.91 mols of gas per 100 grams of solid solution or gas generating composition. Stated another way, the gas generating composition when combusted resulted in 6.76 mols of gas per 100 cubic centimeters of gas generating composition. The total combustion solids were about 3.5 wt % of the total combustion products of gas and solids.

The compositions may be employed in gas generators typically found in airbag devices or occupant protection systems, or in safety belt devices, or in gas generating systems such as a vehicle occupant protection system, all manufactured as known in the art, or as appreciated by one of ordinary skill.

As shown in FIG. 1, an exemplary inflator or gas generator 10 incorporates a dual chamber design containing a primary gas generating composition 12 formed as described herein, wherein the inflator may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
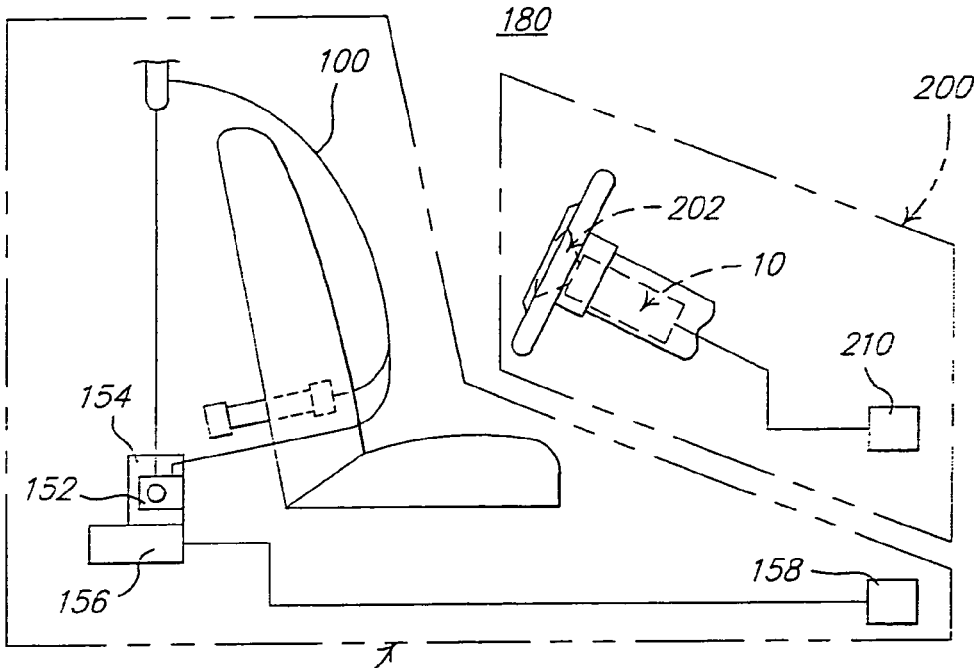
FIG. 2 is a schematic representation of an exemplary vehicle occupant restraint system containing a gas generant composition in accordance with the present invention.

Referring now to FIG. 2, the exemplary inflator or gas generating system 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing gas generating/auto ignition composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention. Rather, the scope of the invention is to be determined by any and all equivalents to the various elements of the invention.

What is claimed is:

1. A gas generating composition comprising:

a primary fuel selected from fumaric acid, succinic acid, barbituric acid, cyanuric acid, and a mixture of two or more of said primary fuels;

a secondary fuel selected from tetrazoles, bitetrazoles, salts of bitetrazoles, derivatives of bitetrazoles, and mixtures thereof; and an oxidizer selected from phase stabilized ammonium nitrate, potassium perchlorate, and mixtures thereof, wherein said composition contains succinic acid, mono-ammonium salt of bitetrazole amine, and phase stabilized ammonium nitrate.

2. The gas generating composition of claim 1 wherein said composition further comprises an oxide selected from molybdenum trioxide, ferric (III) oxide, and mixtures thereof.

3. The gas generating composition of claim 1 wherein said composition further comprises a processing aid selected from silica, graphite, and mixtures thereof.

4. A gas generating composition comprising:

a primary fuel selected from fumaric acid, succinic acid, barbituric acid, cyanuric acid, and a mixture of two or more of said primary fuels;

a secondary fuel selected from tetrazoles, bitetrazoles, salts of bitetrazoles, derivatives of bitetrazoles, and mixtures thereof; and an oxidizer selected from phase stabilized ammonium nitrate, potassium perchlorate, and mixtures thereof, wherein said composition contains fumaric acid, mono-ammonium salt of bitetrazole amine, and phase stabilized ammonium nitrate.

5. A gas generating composition comprising:

a primary fuel selected from fumaric acid, succinic acid, barbituric acid, cyanuric acid, and a mixture of two or more of said primary fuels;

a secondary fuel selected from tetrazoles, bitetrazoles, salts of bitetrazoles, derivatives of bitetrazoles, and mixtures thereof; and an oxidizer selected from phase stabilized ammonium nitrate, potassium perchlorate, and mixtures thereof, wherein said composition contains fumaric acid, mono-ammonium salt of bitetrazole amine, phase stabilized ammonium nitrate, and molybdenum trioxide.

6. The gas generating composition of claim 2 wherein said composition contains succinic acid, mono-ammonium salt of bitetrazole amine, phase stabilized ammonium nitrate, and molybdenum trioxide.

7. A gas generating composition consisting of:

a primary fuel selected from the group consisting of fumaric acid, succinic acid, barbituric acid, cyanuric acid, and a mixture of two or more of said primary fuels;

a secondary fuel selected from the group consisting of tetrazoles, bitetrazoles, salts of bitetrazoles, derivatives of bitetrazoles, and mixtures thereof;

an oxidizer selected from the group consisting of phase stabilized ammonium nitrate, potassium perchlorate, and mixtures thereof;

an oxide selected from the group consisting of molybdenum trioxide and ferric (III) oxide; and an optional processing aid selected from the group consisting of silica, graphite, and mixtures thereof.

8. The gas generating composition of claim 7 consisting of fumaric acid, a bitetrazole, phase stabilized ammonium nitrate, and molybdenum trioxide.

9. The gas generating composition of claim 7 consisting of fumaric acid, a salt of a bitetrazole, phase stabilized ammonium nitrate, and molybdenum trioxide.

10. The gas generating composition of claim 7 consisting of fumaric acid, mono-ammonium salt of bitetrazole amine, phase stabilized ammonium nitrate, molybdenum trioxide, and silica.

11. The gas generating composition of claim 7 consisting of fumaric acid, mono-ammonium salt of bitetrazole amine, phase stabilized ammonium nitrate, potassium perchlorate, molybdenum trioxide, and silica.

12. A gas generating composition comprising:

a primary fuel selected from fumaric acid, said primary fuel provided at about 5-15 weight percent;

a secondary fuel selected from mono-ammonium salt of bitetrazole amine, said secondary fuel provided at about 8-30 weight percent;

an oxidizer selected from phase stabilized ammonium nitrate, potassium perchlorate, and mixtures thereof, said oxidizer provided at about 60-80 weight; and an oxide selected from molybdenum trioxide, ferric (III) oxide, and mixtures thereof, said oxide provided at about 1-5 weight percent, said percents stated by weight of the total gas generating composition.

13. The gas generating composition of claim 12 further comprising a processing aid selected from silica, graphite, and mixtures thereof, said processing aid provided at no more than one weight percent of the total gas generating composition.

14. The gas generating composition of claim 12 comprising fumaric acid at about 10.00 weight percent, mono-ammonium salt of bitetrazole amine at about 15.11 weight percent, phase stabilized ammonium nitrate at about 68.39 weight percent, potassium perchlorate at about 5.00 weight percent, and molybdenum trioxide at about 1.50 weight percent.

15. The gas generating composition of claim 12 comprising fumaric acid at about 9.62 weight percent, mono-ammonium salt of bitetrazole amine at about 13.67 weight percent, phase stabilized ammonium nitrate at about 72.86 weight percent, and molybdenum trioxide at about 3.85 weight percent.

16. The gas generating composition of claim 12 comprising fumaric acid at about 5-15 weight percent; mono-ammonium salt of bitetrazole amine at about 8-30 weight percent; phase stabilized ammonium nitrate and potassium chlorate that combined are provided at about 60-80 weight percent; and molybdenum trioxide at about 1-5 weight percent.

17. The gas generating composition of claim 12 comprising fumaric acid at about 5-15 weight percent; mono-ammonium salt of bitetrazole amine at about 8-30 weight percent phase stabilized ammonium nitrate and potassium chlorate that combined are provided at about 60-80 weight percent; and ferric (III) oxide at about 1-5 weight percent.

* * * * *